US005882096A

United States Patent [19]

Wilhelmstätter et al.

[11] Patent Number: 5,882,096

[45] Date of Patent: Mar. 16, 1999

[54] DISHWASHER

[75] Inventors: Johann Wilhelmstätter, Giengen/Hürben; Helmut Jerg, Giengen; Bernd Schessl, Dillingen; Gerhard Fetzer, Gundelfingen; Michael Hartmann, Höchstädt; Markus Höpfl, Lauingen/Donau; Karl-Heinz Rehm, Dischingen; Rudolf Schmidt, Giengen, all of Germany

[73] Assignee: BSH Bosch und Siemens Hausgeraete GmbH, Munich, Germany

[21] Appl. No.: 821,035

[22] Filed: Mar. 20, 1997

[30] Foreign Application Priority Data

Mar. 20, 1996 [DE] Germany ..... 196 11 055.6

[51] Int. Cl.[6] ..... A47L 15/00

[52] U.S. Cl. ..... 312/228; 134/201; 248/678

[58] Field of Search ..... 312/257.1, 322, 312/228; 134/201; 248/673, 678, 346.5

[56] References Cited

U.S. PATENT DOCUMENTS

| | | | |
|---|---|---|---|
| 2,014,554 | 9/1935 | Buthuis | 312/228 |
| 2,146,939 | 2/1939 | Coordes | 312/228 |
| 4,618,193 | 10/1986 | Cuthbert et al. | 312/228 |

FOREIGN PATENT DOCUMENTS

| | | |
|---|---|---|
| 0452287 | 10/1991 | European Pat. Off. . |
| 1865993 | 10/1962 | Germany . |
| 2016637 | 10/1971 | Germany . |
| 3614345 | 9/1987 | Germany . |
| 3614389 | 9/1987 | Germany . |

*Primary Examiner*—Peter M. Cuomo
*Assistant Examiner*—Gerald A. Anderson
*Attorney, Agent, or Firm*—Herbert L. Lerner; Laurence A. Greenberg

[57] ABSTRACT

In order to equip a dishwasher (1) with a machine base (10), on which a washing container (20) is arranged so as to be capable of being put down in position, in a simple way with a fastening for the washing container (20), said fastening being less complicated and therefore more cost-effective and having better stability, according to the invention the washing container (20) rests, on the rear side, on the upper edge (11) of the machine base (10).

6 Claims, 1 Drawing Sheet

DISHWASHER

BACKGROUND OF THE INVENTION

1. Field of the Invention

The invention relates to a dishwasher having a machine base, on which a washing container is arranged so as to be capable of being put down in position.

2. Description of the Related Art

German Patent Specification 36 14 345 discloses a dishwasher of the type mentioned initially, in which a washing container is fastened to a machine base, which is designed as a mounting tub and carries the appliance assemblies and which is preferably made from thermoplastic, on the rear side by means of a tilting mounting and on the front side by means of stays inserted in integrally molded receptacles and fastened to the washing container. This fastening is complicated and therefore expensive.

SUMMARY OF THE INVENTION

The object on which the invention is based is, therefore, to equip an initially mentioned dishwasher in a simple way with a fastening for the washing container, said fastening being less complicated and therefore more cost-effective and having better stability.

The object is achieved, according to the invention, in that the washing container rests, on the rear side, on the upper edge of the machine base.

Since the washing container rests directly on the upper edge of the machine base, additional outlay for the rear mounting of the washing container is avoided and consequently the fastening of the washing container to the mounting base becomes substantially less complicated and substantially more cost-effective. Since the washing container rests directly on the upper edge of the machine base, direct absorption of force between the washing container and machine base is achieved, thus leading to a better stability of the connection and therefore of the dishwasher. The arrangement according to the invention thus makes it possible in a simple way to equip an initially mentioned dishwasher with a fastening for the washing container, said fastening being less complicated and therefore more cost-effective and having better stability.

According to a preferred feature of the invention, a projecting rearward edge of the washing container rests at least partially on the upper edge of the machine base. Since the projecting edge rests directly, it becomes possible for force to be introduced into the machine base via a crumple zone, that is to say with a zone deformable as a result of the effect of force without disadvantages for the functioning or appearance of the washing container.

Advantageously, the projecting rearward edge of the washing container extends at least over the entire width of the washing container and rests over the entire width on the upper edge of the machine base, thereby achieving an even better introduction of force.

According to a preferred embodiment of the invention, the projecting rearward edge of the washing container rests on a step of the machine base.

According to a further preferred feature of the invention, the projecting rearward edge and a cant of the washing container rest on the edge of the machine base. This double rest also affords a double safeguard against damage to the washing containing, for example during a drop test.

A further improvement in safeguarding against damage to the washing container is achieved, according to a preferred embodiment of the invention, in that the cant of the washing container rests on a resilient projection of the upper edge of the machine base.

Advantageously, the washing container is fastened to the machine base by means of two screws guided through bores in the edge of the washing container, thereby achieving a further simplification in the fastening of the washing container.

Expediently, the bores are arranged in the corner regions of the edge of the washing container. Since there are large surfaces in the corner regions of the edge of the washing container, weakening of the fastening by the bores is kept as slight as possible, thus further increasing the safety of the fastening.

BRIEF DESCRIPTION OF THE DRAWING

The invention is explained below with reference to the exemplary embodiment illlustrated in the drawing, in which.

DESCRIPTION OF THE PREFERRED EMBODIMENTS

Figure 3:
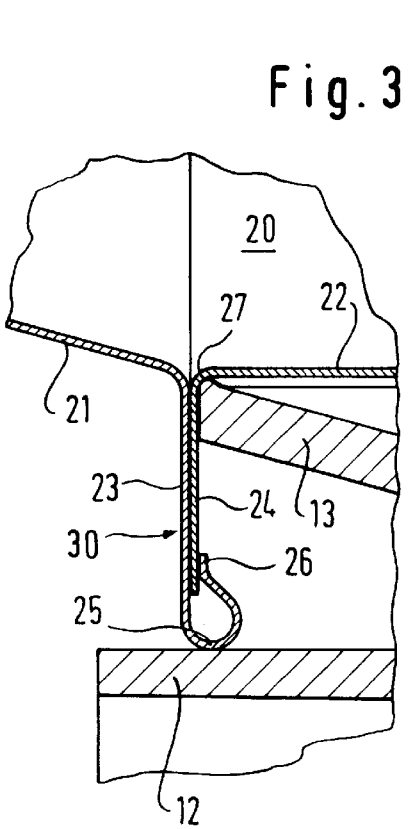
FIG. 3 shows an enlarged illustration of the detail III in FIG. 1.
Figure 2:
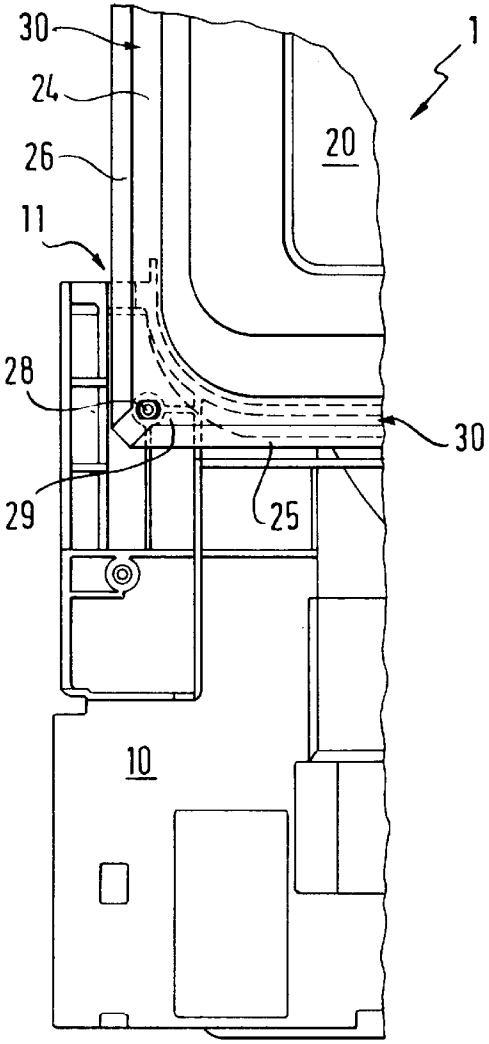
FIG. 2 shows a partial rear view of the machine base with a washing container put down in position on it.
Figure 1:
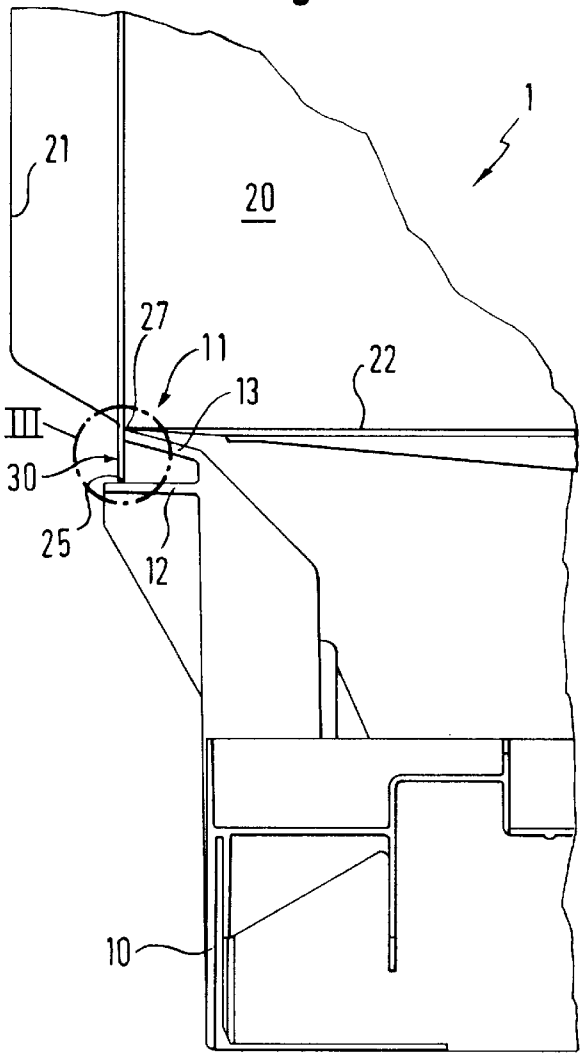
FIG. 1 shows a partial section through a side view of a machine base with a washing container put down in position on it.

A dishwasher 1 according to the invention has a machine base 10 which, in the exemplary embodiment, is manufactured from a thermoplastic and which accommodates appliance assemblies of the dishwasher 1 which are not explained in any more detail. A washing container 20 is put down in position on the machine base 10. According to the invention, the washing container 10 rests, on the rear side, on an upper edge 11 of the machine base 10.

In the exemplary embodiment shown, the washing container 20 consists of two sheet metal parts 21, 22 made from high-grade stainless steel and is of box-shaped design. One sheet metal part 22 forms the two side walls, the upper wall and the bottom of the washing container 20, and the other sheet metal part 21 forms the rear wall of the washing container 20. The two sheet metal parts 21, 22 have, along their edge zones facing one another, flanges 23, 24 which are arranged externally on the washing container 20 and on which said sheet metal parts are connected to one another by welding, in the exemplary embodiment shown by resistance roller seam welding.

In the demounted state, the flanges 23 of the rear wall 21 project beyond the flanges 24 of sheet metal part 22 of the further parts of the washing container 20. After the flanges 23, 24 have been welded together, these projecting parts 25 of the flanges 24 of the rear wall 21 are bent round in the direction of the sheet metal part 22 of the further parts of the washing container 20 so as to overlap the flanges 24 of said sheet metal part 22. The arrangement after this bending-round operation can best be seen in FIG. 3. It can also best be seen in FIG. 3 that, in the exemplary embodiment shown, this bent-round portion of the flange parts 25 has the form of a crimping resembling a hollow profile, and that an outermost edge 26 of the bent-round flange parts 25 of the rear wall 21 rests on the flanges 24 of the sheet metal part 22 of the further parts of the washing container 20.

The welded-together flanges 23, 24, together with the bent-round portion 25, form the rearward projecting edge 30 of the washing container 20 of the dishwasher 1 according to the invention, in the exemplary embodiment shown said edge extending at least over the entire width of the washing container 20 and, according to the invention, resting at least partially on the upper edge 11 of the machine base 10, in the exemplary embodiment shown over the entire width on a step 12 of the upper edge 11 of the machine base 10.

A cant 27 of the washing container 20, said cant being formed at the bend of the further sheet metal part 22 of the washing container 20, rests on a resilient projection 13 of the upper edge 11 of the machine base 10.

The washing container 20 is fastened to the machine base 10 by means of two screws (not shown) guided through bores 28 in the edge 30 of the washing container 20, the bores 28 being arranged in the corner regions 29 of the edge 30.

The arrangement according to the invention makes it possible in a simple way to equip a dishwasher 1 with a fastening for the washing container 20, said fastening being less complicated and therefore more cost-effective and having better stability.

We claim:

1. A dishwasher, comprising:

a machine base having a rear side with an upper edge; and a washing container formed with a projecting rearward edge and a cant, said projecting rearward edge and said cant being supported on said upper edge of said machine base.

2. The dishwasher according to claim 1, wherein said rearward edge of said washing container extends over an entire width of said washing container and rests on said upper edge of said machine base on an entire width thereof.

3. The dishwasher according to claim 2, wherein said machine base has a step formed at said upper edge and said projecting rearward edge of said washing container rests on said step of said machine base.

4. The dishwasher according to claim 1, wherein said machine base is formed with a resilient projection at said upper edge, said resilient projection supporting said cant of said washing container.

5. The dishwasher according to claim 1, wherein said washing container is fastened to said machine base by means of two screws each extending through a respective bore formed in said edge of said washing container.

6. The dishwasher according to claim 5, wherein said edge of said washing container includes two corner regions, and said bores are formed in said corner regions of said edge.

* * * * *